US005392818A

United States Patent [19]

Seiler et al.

[11] Patent Number: 5,392,818

[45] Date of Patent: Feb. 28, 1995

[54] PIEZOELECTRIC TYPE NEEDLE SELECTOR FOR JACQUARD WEAVING MACHINES

[76] Inventors: Wolfgang Seiler, Azaleenweg 17, D-41189 Monchengladbach; Rudolf Erich, Am Stapp 2, D-41844 Wegberg, both of Germany

[21] Appl. No.: 210,630

[22] Filed: Mar. 18, 1994

[30] Foreign Application Priority Data

Apr. 28, 1993 [DE] Germany ..... 9306377[U]

[51] Int. Cl.[6] ..... D03C 3/20

[52] U.S. Cl. ..... 139/59; 139/455

[58] Field of Search ..... 139/59, 68, 455

[56] References Cited

U.S. PATENT DOCUMENTS 3,871,415 3/1975 Wolfgang et al. ..... 139/59
4,566,499 1/1986 Kitagawa et al. ..... 139/59
5,027,619 7/1991 Saito ..... 139/455

*Primary Examiner*—Andrew M. Falik

*Attorney, Agent, or Firm*—Mason, Kolehmainen, Rathburn & Wyss

[57] ABSTRACT

A needle selector apparatus for a Jacquard machine has drop needles and thrust needles which are supported thereby and which are horizontally and vertically movable by way of control devices. A blocking element is associated with the end of each drop needle and can selectively provide support for the end of the drop needle or permit the drop needle to drop down. The adjusting element of each blocking element is a respective piezoelectric flexural transducer which is stationarily clamped at one end. Each transducer is arranged with its longitudinal direction transversely to the longitudinal direction of the associated drop needle. The free end of each transducer is movable between the support position of lying in the path of movement of the drop needle and the drop-down position of lying outside the path of movement of the drop needle, in a plane which is transverse to the longitudinal direction of the drop needle.

6 Claims, 1 Drawing Sheet

Fig. 1
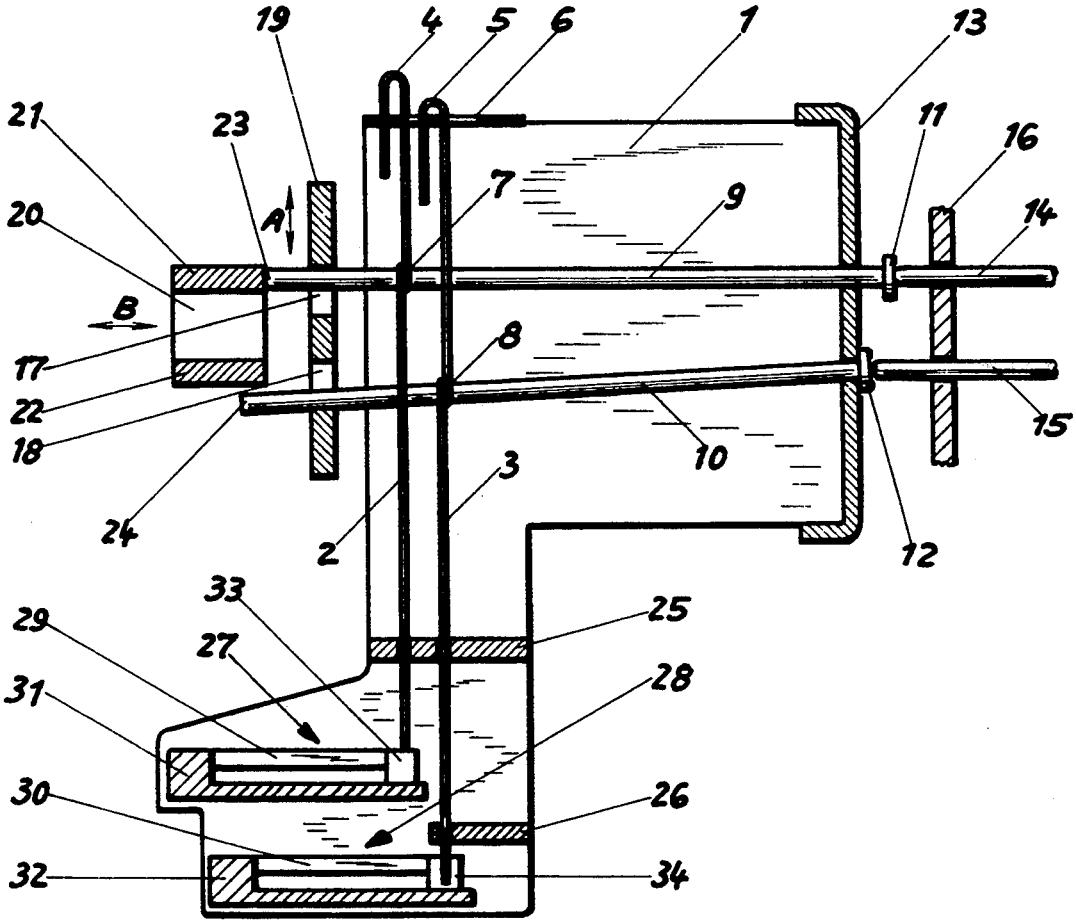
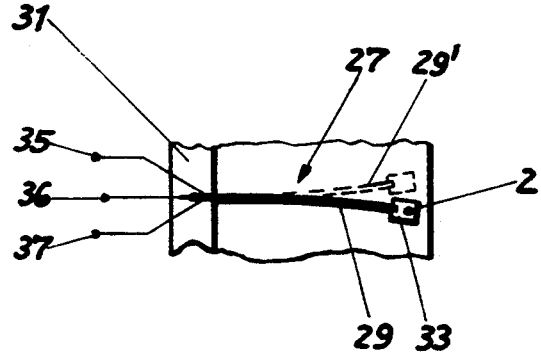
Fig. 2

PIEZOELECTRIC TYPE NEEDLE SELECTOR FOR JACQUARD WEAVING MACHINES

BACKGROUND OF THE INVENTION

One form of needle selector apparatus for a Jacquard machine comprises a plurality of vertically movable drop needles, and thrust needles which are mounted therein and which are thus movable vertically and also horizontally by way of control devices. A respective blocking element is associated with an end of each drop needle in such a way as selectively to provide support for the end of the drop needle in a first support position or permit the drop needle to drop down in a second release or drop-down position The adjusting element of each blocking element which provides for displacement thereof between the first and second positions is a respective piezoelectric flexural transducer which is stationarily clamped at one end. A needle selector apparatus for Jacquard machines of that kind is to be found in DE 37 05 738 Al wherein the piezoelectric flexural transducers are disposed extending in the longitudinal direction of the drop needles, that is to say vertically, and are each stationarily clamped by means of their lower end. The upper free end of each of the piezoelectric flexural transducers can be pivoted by way of an electrical control device between the support or blocking position in which the ends of the drop needles come to bear against the respective flexural transducer and the release or drop-down position in which the respective piezoelectric flexural transducer is outside the path of movement of the respective drop needle.

That arrangement involves a structural configuration which takes up a great deal of space, more particularly especially in the longitudinal direction of the drop needles.

SUMMARY OF THE INVENTION

An object of the present invention is to provide a needle selector apparatus for a Jacquard machine, which is of a compact structure.

Another object of the present invention is to provide a needle selector apparatus for Jacquard machines, which affords enhanced operational reliability in respect of needle selection while still being of comparable structural simplicity.

In accordance with the present invention the foregoing and other objects are attained by a needle selector apparatus for a Jacquard machine, having drop needles, thrust needles which are mounted therein movably vertically and horizontally, and control means for displacing the thrust needles. A respective blocking element is associated with each drop needle, for example at an end thereof, and is adapted selectively to provide support for the end of the drop needle in a support position or to permit the drop needle to drop down in a drop-down position. Each blocking element has an adjusting element for displacing same between the support and drop-down positions, comprising a respective piezoelectric flexural transducer which is stationarily clamped at one end. The respective piezoelectric flexural transducer is arranged in its longitudinal direction transversely to the longitudinal direction of the associated drop needle, the free end of the flexural transducer being movable between the support position of lying in the path of movement of the drop needle and the drop-down position of lying outside the path of movement of the drop needle, in a plane which is transverse to the longitudinal direction of the drop needle.

As will be seen in greater detail hereinafter the above-mentioned configuration according to the invention can afford the advantage that the blocking elements, of which a large number are usually to be provided in a Jacquard machine (for example 1344 items in conventional types) can be arranged in such a manner as to save space.

A preferred feature of the invention provides that the blocking elements for the drop needles which are respectively arranged in a row in the longitudinal direction of the thrust needles are arranged in a stepped array in different positions in respect of height, the drop needles being of different lengths according to the positions in respect of height of the blocking elements.

In accordance with a further preferred feature of the invention the apparatus comprises at least one common drop needle guide associated with the drop needles which are arranged in a respective row in the longitudinal direction of the thrust needles, and separate drop needle guides which are provided near the respective end associated with the blocking element, according to the different lengths of the drop needles. That arrangement can provide that the drop needles are also reliably guided in the region of the blocking elements, which can at least contribute to eliminating control malfunctions.

In a further preferred feature of the invention the blocking elements associated with the drop needles which are arranged in a row transversely to the longitudinal direction of the thrust needles and which are respectively of the same length respectively can have a plurality of piezoelectric flexural transducers arranged on a common carrier, and the carriers can be mechanically easily interchangeably arranged in the needle selector apparatus. This affords a modular structure that is particularly service-friendly.

In a further configuration of the invention it can be provided that the carriers respectively have electrical circuit boards for electrical actuation of the piezoelectric flexural transducers. That arrangement means that there is no need to dispose the electronic circuit board for example in a switch cabinet which would then have to be erected at a greater distance from the needle selector apparatus.

In accordance with another preferred feature of the invention the piezoelectric flexural transducers may each have a thickened head portion in the region of their respective free end. That arrangement on the one hand provides a secure support surface for the respective drop needle while on the other hand the thickened head portion can also serve at the same time as electrical insulation and in addition can be of a wear-resistant nature.

Further objects, features and advantages of the invention will be apparent from the following description of a preferred embodiment.

BRIEF DESCRIPTION OF THE DRAWING

FIG. 1 is a diagrammatic side view in section of part of a needle selector apparatus according to the invention showing only two thrust needles, two drop needles and two blocking elements; and FIG. 2 is a diagrammatic plan view of the upper blocking element illustrated in FIG. 1.

DESCRIPTION OF THE PREFERRED EMBODIMENT

Referring to FIG. 1, a needle selector apparatus for a Jacquard machine, of which part is shown in FIG. 1, comprises a housing 1 in which drop needles 2 and 3 are vertically movably disposed. The drop needles 2 and 3 at their respective upper ends have hook regions 4 and 5. The drop needles 2 and 3 are guided with their hook regions 4 and 5 through corresponding openings in an upper drop needle guide plate 6. The drop needles 2 and 3 also have eyes 7 and 8 which are intermediate their ends and through which are slidably guided substantially horizontally disposed thrust needles 9 and 10. At their ends which are shown at the right in FIG. 1 the thrust needles 9 and 10 have enlarged heads 11 and 12. The thrust needles 9 and 10 are guided in that region through openings in a lateral thrust needle guide plate 13. When the thrust needles are displaced towards the right in FIG. 1 the heads 11 and 12 operatively engage and thus urge away main needles 14 and 15 which are horizontally displaceably guided in a main needle guide board 16 and which serve to actuate hooks (not shown) of a Jacquard machine. The thrust needles 9 and 10 are also guided through openings 17, 18 in a lift plate 19 which is vertically movable in the direction of the double-headed arrow A by way of a control device (not shown). The arrangement also has a pressing 9rid member which is identified by reference numeral 20 and which is reciprocatable by way of a control device (not shown) in the direction indicated by the double-headed arrow B. The pressing grid member 20 has pressure bars 21 and 22 which can serve to press against the ends 23, 24 of the thrust needles 9 and 10, which are illustrated at the left in FIG. 1.

Drop needle guides 25 and 26 are also provided in the housing 1. The drop needle guide 25 is common to the drop needles 2 and 3 and serves for simultaneously guiding the drop needles 2 and 3, while the drop needle guide 26 which is arranged in the vicinity of the lower end of the drop needle 3 serves only to guide the respective drop needle 3.

The apparatus also has blocking elements 27 and 28 which each have a respective adjusting element for displacing same in a manner to be described hereinafter, in the form of piezoelectric flexural transducers 29 and 30. The piezoelectric flexural transducers 29 and 30 are stationarily fixedly clamped in a respective carrier 31 and 32, at the end of the respective transducer which is at the left in FIG. 1 and also FIG. 2. The free end of each of the piezoelectric flexural transducers 29, 30 has a thickened head portion 33, 34. The electrical terminals of a piezoelectric flexural transducer are diagrammatically shown in FIG. 2 and indicated by reference numerals 35, 36 and 37.

It will be appreciated that in actual fact, a needle selector apparatus for a Jacquard machine does not have for example only two thrust needles and drop needles, but it has for example in a row in the longitudinal direction of the thrust needles (and therefore in the plane of FIG. 1) 16 drop needles and 16 thrust needles. Arranged perpendicularly to the plane of FIG. 1 are drop needles and thrust needles in a plurality of rows, in superposed relationship, for example 84 rows, which then have for example therefore 84 drop needles which correspond to the drop needles 2, 84 drop needles which correspond to the drop needle 3, and so forth.

The blocking elements 27, 28 are arranged transversely to the longitudinal direction of the drop needles 2, 3, which makes it possible to adopt a compact structure. As can be seen from FIG. 1 the blocking elements 27 and 28 are also disposed in a stepped arrangement. Accordingly the drop needles 2, 3 are of different lengths and the drop needles (not shown) which are disposed in adjoining relationship towards the right in FIG. 1 are similarly each longer by a corresponding step.

The structure of the needle selector apparatus having been set out above, its mode of operation will now be described as follows:

As shown in FIG. 1, the pressing grid member 20 is in a position in which it has urged the end 23 of the thrust needle 9 away towards the right, by means of the upper pressure bar 21. The upper thrust needle 9 had previously been moved by the drop needle 2 which is in an upper position into a position in which the end 23 could thus be appropriately engaged by the pressure bar 21 of the pressing grid member 20.

In comparison, due to the action of the drop needle 3, the lower thrust needle 10 had been pivoted into a downward position in which the end 24 of the lower thrust needle 10 could not be engaged by the lower pressure bar 22 of the pressing grid member 20.

When then the pressing grid member 20 moves in the direction indicated by the arrow B towards the left in FIG. 1, and in addition the lift plate 19 lifts the needles 9 and 10 in the upward direction indicated by the arrow A, more specifically to such an extent that the lower ends of the drop needles 2 and 3 move to a position in which they are disposed freely above the thickened head portions 33 and 34 of the blocking elements 27 and 28, the piezoelectric flexural transducers 29, 30 of the blocking elements may pivot or not pivot in accordance with a pattern presetting of a program, thus for example into the position indicated in broken lines at 29' in FIG. 1. The free end of each of the transducers thus moves between the position for supporting the respective drop-needle, in which it lies in the path of movement thereof, and the position for permitting the drop needle to drop down, in which it is outside the path of movement thereof, in a plane which is transverse in the longitudinal direction of the drop needle.

If then the lift plate 19 is moved downwardly in the direction indicated by the arrow A, the lower ends of the drop needles 2 and 3 are either supported on the head portions 33, 34 of the piezoelectric flexural transducers, or they are not supported thereon and can drop down, depending on the position occupied by the respective flexural transducer. FIG. 1 shows that the drop needle 3 is not supported on the thickened head portion 34 of the piezoelectric flexural transducer 30 as the latter has been pivoted perpendicularly to the plane of FIG. 1 into the drop-down or non-support position corresponding to the position 29' shown in FIG. 2. As a result the thrust needles 9 and 10 have either been pivoted or not pivoted in a vertical direction and thereby they have either been moved into the position for being urged away towards the respective main needle 14, 15 or into the position for not being urged away. If then the pressing grid member 20 is moved in the direction indicated by the arrow B towards the right, the thrust needles are either urged away towards the right in FIG. 1 by the respective bar 21, 22, or not urged away.

The necessary movement of the thrust needles 9, 10 in the direction indicated by the arrow B towards the left is produced by way of suitable spring devices (not shown) which may be associated for example with the main needles 14, 15 or the hooks (not shown) of the Jacquard machine.

The carriers 31, 32 are respectively provided for a plurality of piezoelectric flexural transducers which are associated with the respective drop needles of the same length (that is to say for example the drop needles 2 or 3). The carriers 31, 32 are of a modular structure and are easily interchangeably mounted in the apparatus. In addition provided in the region of the respective carriers 31 and 32 are respective electrical circuit boards (not shown) which serve for electrical actuation of the piezoelectric flexural transducers and which can also be of such a design that the devices for stationarily clamping the respective end of each piezoelectric flexural transducer are also integrated into the electrical circuit board.

It will be appreciated that the above-described apparatus has been set forth solely by way of example and illustration of the present invention and that various other modifications and alterations may be made therein without thereby departing from the scope of the invention.

What is claimed is:

1. A needle selector apparatus for a Jacquard machine, said apparatus comprising drop needles and respective thrust needles supported thereby, for movement both horizontally and vertically, control means for moving said thrust needles, and blocking elements which are operatively associated with a respective drop needle and which are selectively displaceable between a first position for providing support for a respective drop needle and a second position for permitting said respective drop needle to drop down, each blocking element including an adjusting element comprising a respective piezoelectric flexural transducer having a first end at which it is stationarily clamped, the respective piezoelectric flexural transducer being arranged with its longitudinal direction transversely to a longitudinal direction of an associated drop needle, and a free end of each flexural transducer being movable between said first support position lying in the path of movement of a respective drop needle and said second drop-down position lying outside the path of movement of said respective drop needle, in a plane which is transverse to the longitudinal direction of said respective drop needle.

2. A needle selector apparatus according to claim 1 wherein each blocking element includes support means engageable with an end of respective drop needle for supporting the same in an elevated position while in said first support position.

3. A needle selector apparatus according to claim 1 comprising at least one pair of said drop needles which are respectively arranged in parallel alignment transversely of a longitudinal direction of said thrust needles, and wherein said blocking elements for said one pair of drop needles are stepped at different height levels, and wherein said one pair of drop needles are of different lengths corresponding to said different heights of said blocking elements.

4. A needle selector apparatus according to claim 2 comprising at least one pair of said drop needles respectively arranged in parallel alignment transversely of a longitudinal direction of said thrust needles, and further including at least one common drop needle guide operatively associated with said one pair of drop needles, and a lower separate drop needle guide disposed near the end of a longer one of said one pair of drop needles and associated with said blocking element.

5. A needle selector apparatus according to claim 1 wherein at least one pair of said drop needles is arranged in parallel alignment transversely to a longitudinal direction of said thrust needles, said thrust needles being substantially the same length, and further including a common carrier means for a respective plurality of piezoelectric flexural transducers associated with said one pair of said drop needles, said transducers being mechanically easily interchangeable on carrier means of said needle selector apparatus.

6. A needle selector apparatus according to claim 1 wherein each piezoelectric flexural transducer has a thickened head portion in the region of its free end.

* * * * *